US010016642B2

(12) United States Patent
Johnsen et al.

(10) Patent No.: US 10,016,642 B2
(45) Date of Patent: Jul. 10, 2018

(54) INJECTOR DEVICE FOR AN AIRCRAFT FIRE-FIGHTING SYSTEM

(75) Inventors: Nina Johnsen, Scheessel (DE); Paul Rohrbach, Bremen (DE)

(73) Assignee: AIRBUS OPERATIONS GMBH, Hamburg (DE)

( * ) Notice: Subject to any disclaimer, the term of this patent is extended or adjusted under 35 U.S.C. 154(b) by 1435 days.

(21) Appl. No.: 13/249,311

(22) Filed: Sep. 30, 2011

(65) Prior Publication Data

US 2012/0255746 A1 Oct. 11, 2012

Related U.S. Application Data

(60) Provisional application No. 61/388,779, filed on Oct. 1, 2010.

(51) Int. Cl.

| | |
|---|---|
| ***A62C 3/07*** | (2006.01) |
| ***A62C 31/05*** | (2006.01) |
| ***A62C 3/08*** | (2006.01) |

(52) U.S. Cl.

CPC ..... *A62C 31/05* (2013.01); *A62C 3/08* (2013.01)

(58) Field of Classification Search

CPC ..... A62C 31/02; A62C 31/05; B64D 45/00; C09J 7/045

USPC ..... 169/62, 66, 54; 239/589, 548; 428/920

See application file for complete search history.

(56) References Cited

U.S. PATENT DOCUMENTS

| | | | | |
|---|---|---|---|---|
| 6,206,301 | B1 * | 3/2001 | Pruett | B05B 15/0208 239/116 |
| 6,488,098 | B1 * | 12/2002 | Davis et al. | 169/54 |
| 7,028,431 | B2 * | 4/2006 | Tlemcani et al. | 49/8 |
| 2006/0011108 | A1 * | 1/2006 | Abu-Isa et al. | 108/57.25 |
| 2008/0292854 | A1 * | 11/2008 | Miller et al. | 428/219 |
| 2010/0255202 | A1 * | 10/2010 | Kreilos | 427/314 |

FOREIGN PATENT DOCUMENTS

| | | | |
|---|---|---|---|
| EP | 0505940 | A1 | 9/1992 |
| GB | 2 120 580 | A | 12/1983 |
| GB | 2 312 619 | A | 11/1997 |

* cited by examiner

*Primary Examiner* — Davis Hwu

(74) *Attorney, Agent, or Firm* — Carter, DeLuca, Farrell & Schmidt LLP

(57) ABSTRACT

The present disclosure relates to a nozzle device for discharging a fire extinguishing medium into a cargo hold of an aircraft. In order to achieve a reduced weight of a nozzle device while at the same time providing fire protection properties that satisfy the approval requirements, a nozzle device for discharging a fire extinguishing medium into a cargo hold of an aircraft is proposed, which is characterized in that the nozzle device is made of aluminum and/or an aluminum alloy and/or a CFRP material and the nozzle device has a layer of an intumescent material at least on a side facing the cargo hold in the installed state.

18 Claims, 2 Drawing Sheets

INJECTOR DEVICE FOR AN AIRCRAFT FIRE-FIGHTING SYSTEM

TECHNICAL FIELD

The invention relates to a nozzle device for discharging a fire extinguishing medium into a cargo hold of an aircraft.

BACKGROUND

Fixed installations of nozzle devices of this kind are known as component parts of aircraft fire extinguishing systems for cargo holds. The nozzle devices are connected via a pipeline system to storage tanks containing fire extinguishing medium and are used, on activation of the fire extinguishing system, for purposeful discharge (spraying, sprinkling etc.) of the fire extinguishing medium into a cargo hold.

Depending on their size, cargo holds have one or more of these nozzle devices, in order to achieve optimum distribution of the fire extinguishing medium and therefore optimum fire fighting. In the present text the term "nozzle device" is to be understood in its broad sense. It comprises at least one discharge nozzle and optionally further parts, for example a nozzle holder, with which the discharge nozzle is secured in or on a cargo hold wall. Such nozzle holders can be specially shaped, to support intentional, purposeful discharge of the fire extinguishing medium leaving the discharge nozzle and to protect the discharge nozzle against damage during loading operations.

The known nozzle devices are typically made of stainless steel and have corrosion protection applied thereon, which is formed in a great variety of ways, for example by a zinc-nickel coating or with an adhesive protective film. In case of fire, the nozzle devices must maintain their function and integrity under the action of specified temperatures, for example 900-1000° C., for a specified minimum time of action, for example 5 min. This must be demonstrated in corresponding tests within the scope of component approval. Further material requirements are given in the approval or construction specifications.

In the course of the constant efforts in aircraft construction to achieve weight reduction, the problem to be solved by the invention is to provide a nozzle device that fulfills the approval criteria with respect to fire protection and is lighter than the known nozzle devices.

SUMMARY

The invention follows from the features of the independent claim. Advantageous further developments and embodiments are the object of the dependent claims. Further features, possible applications and advantages of the invention follow from the description hereunder, and the explanation of examples of carrying out the invention, which are illustrated in the drawings.

The problem is solved with a nozzle device for discharging a fire extinguishing medium into a cargo hold of an aircraft, in that the nozzle device is made of aluminum and/or an aluminum alloy and/or a carbon-fiber-reinforced plastic and the nozzle device has a layer of intumescent material at least on a side facing the cargo hold in the installed state.

These intumescent materials are used in various fields of application. In addition to the building industry and the electrical engineering industry, this group of materials is being used increasingly in aircraft construction. Intumescent materials are characterized in that when an initial temperature is exceeded, they form an incombustible, heat-insulating foam structure. The initial volume can increase by a large factor during this reaction, and the direction of foaming of this foam structure is primarily directed toward the heat source. The heat-insulating capacity of the foam structure that forms provides thermal protection for structures coated with said material, for example against direct action of flame in a fire.

The essence of the invention consists in replacing the steel with the necessary anticorrosion coating used for making known nozzle devices with a combination of aluminum and/or an aluminum alloy and/or a CFRP with a suitable coating of an intumescent material. In the present text the abbreviation CFRP stands for carbon fiber reinforced plastic (also known as "carbon fiber composite") and is widely understood.

Aluminum or aluminum alloys are not suitable per se for the production of nozzle devices of this kind owing to their relatively low melting point (660° C. for AL). It is only by the combination according to the invention with an intumescent material that it becomes possible to produce a nozzle device with markedly lower weight, which at the same time fulfills the approval requirements relating to fire protection. Thus, by providing nozzle devices according to the invention for example made of aluminum with an intumescent coating, a weight reduction of up to 3.1 kg can be achieved in a large-volume aircraft instead of the existing nozzle devices.

Advantageously, the intumescent material is in particular applied as a coating only on the side of the nozzle device facing the cargo hold in the installed state, so that a fire in the cargo hold can only act upon the surface of the nozzle device that is protected by the intumescent material.

At present the inventors are aware of two commercially available intumescent materials that fulfill the current approval specifications (for example EASA CS 25.851 (b), CS 25.855, FAR 25.856 (b)). These are: Pyro-Safe from the company SVT [(DE), www.svt.de] and Pyro-Tape from the company Bradford Industries [(US), www.bradfordind-.com]. Of course, a person skilled in the art knows of other possible intumescent materials that are suitable for the layer according to the invention. In this connection, reference may be made for example to the publication EP 0 505 940 B1, in which intumescent, fire-resistant coatings, fire-resistant materials, and methods of production of said intumescent materials are described.

In a preferred embodiment the layer of intumescent material has a layer thickness of more than 100 μm, in particular more than 150 μm.

The nozzle device preferably comprises a discharge nozzle and a discharge nozzle holder. An especially preferred further development of the nozzle device is characterized in that the discharge nozzle is made of aluminum or an aluminum alloy and the discharge nozzle holder is made of a CFRP material. The discharge nozzle holder then preferably has a material thickness (CFRP) in the range from 0.75 to 1.5 mm. With this embodiment, relative to the example given above, in which a weight reduction of 3.1 kg was achieved for a large-volume aircraft, a further 30% weight saving can be made, i.e. in the present case 0.93 kg.

Another preferred embodiment is characterized in that the layer of intumescent material is applied directly on the surface of the aluminum or of the aluminum alloy or of the carbon-fiber-reinforced plastic.

Another preferred embodiment is characterized in that an anticorrosion layer is applied between the layer of intumescent material and a surface of the aluminum or of the aluminum alloy.

BRIEF DESCRIPTION OF THE DRAWINGS

Further advantages, features and details can be seen from the following description, in which an example is described in detail, referring to the drawings. Features that are described and/or are shown in drawings form, in themselves or in any reasonable combination, the object of the invention, optionally also independently of the claims, and can in particular also additionally be the object of one or more separate application(s). Identical, similar and/or functionally identical parts are given the same reference symbols.

The drawings show.

DETAILED DESCRIPTION

Figure 1:
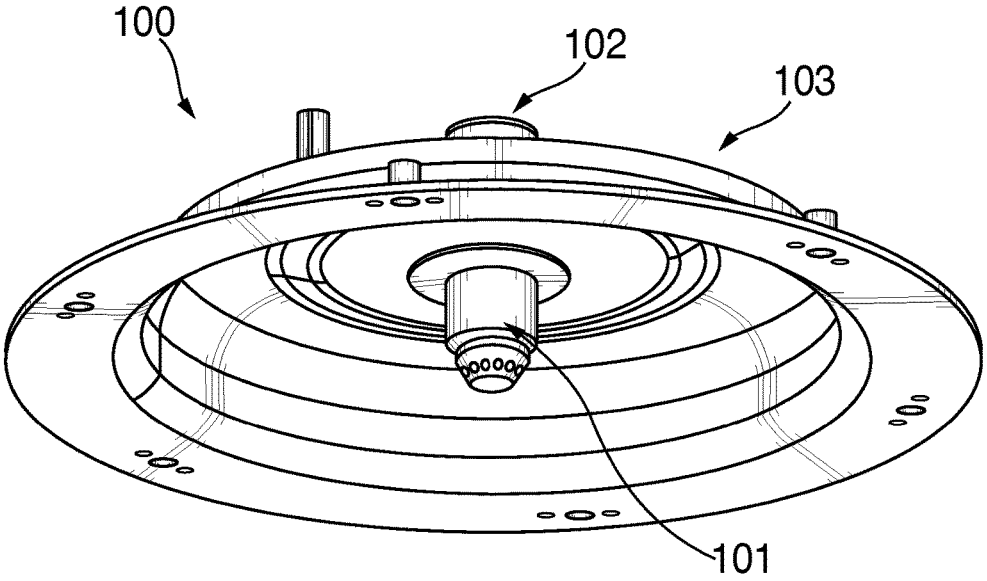
FIG. 1 PRIOR ART
FIG. 1 is an example of a known nozzle device (prior art)

FIG. 1 (prior art) shows a known nozzle device 100 for a cargo hold of an aircraft, which comprises a connection 102 to a pipeline system, via which, in the case of activation of the fire extinguishing system, the fire extinguishing medium, for example Halon 1301, is supplied to the nozzle device 100. Furthermore, the nozzle device 100 comprises a discharge nozzle 101, which in the present case has several outlet orifices, through which the fire extinguishing medium can be discharged into a cargo hold, and a discharge nozzle holder 103, which on the one hand serves for securing the nozzle device 100 on or in a wall of the cargo hold, and which on the other hand, through its concave shape, supports purposeful discharge of the fire extinguishing medium into the cargo hold. Furthermore, with its recessed arrangement in the dish-shaped discharge nozzle holder 103, the discharge nozzle 101 is protected against being damaged during loading operations.

The nozzle device 100, i.e. in the present case the discharge nozzle 101 and the discharge nozzle holder 103, is made in the prior art from stainless steel and has an anticorrosion coating, in the present case a zinc-nickel coating.

Figure 2:
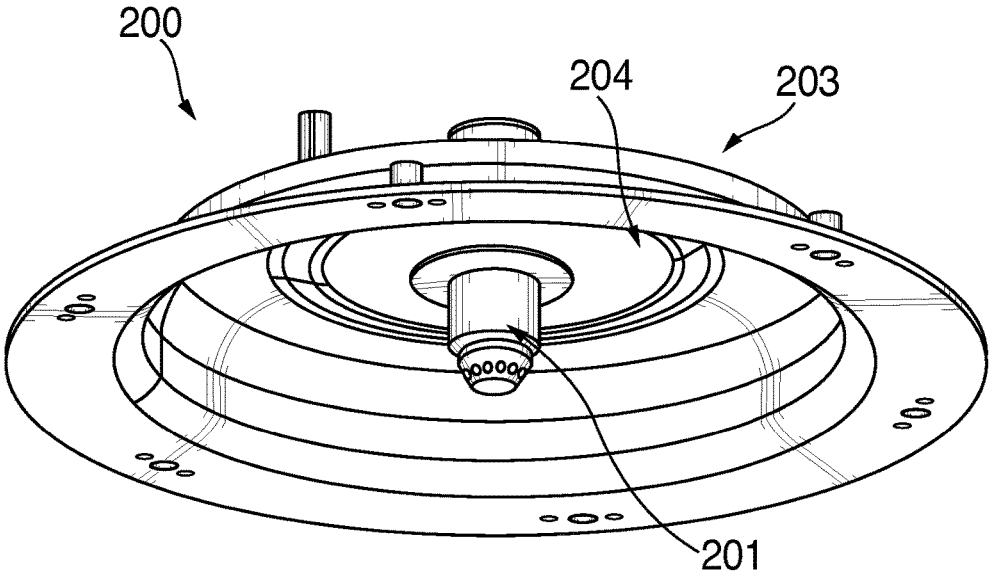
FIG. 2 is a nozzle device according to the invention.

FIG. 2 shows a nozzle device 200 according to the invention, which differs from that shown in FIG. 1 in that the nozzle device 200, i.e. in the present case the discharge nozzle 201 consists of aluminum or an aluminum alloy and the discharge nozzle holder 203 consists of a CFRP material. The discharge nozzle holder 203 has a material thickness of 1 mm. According to the invention, a layer 204 of intumescent material with, in the present case, a layer thickness of 150 μm is applied on the side of the nozzle device 200 facing the interior of the cargo hold.

The present invention makes it possible to produce nozzle devices of reduced weight while simultaneously fulfilling the fire protection requirements. This weight reduction contributes to a decrease in the amount of fuel required for operation of the aircraft and ultimately to a decrease in environmental impact. Also, for example, expensive zinc-nickel coatings of the nozzle devices are no longer required.

The invention claimed is:

1. A nozzle device for discharging a fire extinguishing medium into a cargo hold of an aircraft, the nozzle device comprising:

a discharge nozzle and a discharge nozzle holder, the discharge nozzle being made of aluminum and/or an aluminum alloy, the discharge nozzle holder being made entirely of carbon-fiber-reinforced plastic, wherein a layer of an intumescent material is applied directly on a surface of the discharge nozzle facing the cargo hold and on a surface of the discharge nozzle holder facing the cargo hold, wherein the discharge nozzle holder is configured to be secured directly on a wall of the cargo hold.

2. The nozzle device according to claim 1, wherein the discharge nozzle holder has a material thickness in the range from 0.75 to 1.5 mm.

3. The nozzle device according to claim 1, wherein the layer of intumescent material has a layer thickness of more than 100 μm.

4. The nozzle device according to claim 1, wherein the layer of intumescent material has a layer thickness of more than 150 μm.

5. The nozzle device according to claim 1, wherein an anticorrosion layer is applied between the layer of intumescent material and the surface of the aluminum or the aluminum alloy of the discharge nozzle.

6. A nozzle device for discharging a fire extinguishing medium into a cargo hold of an aircraft, the nozzle device comprising:

a body portion;

a discharge nozzle holder made entirely of carbon-fiber-reinforced plastic, wherein the discharge nozzle holder is configured to be secured directly on a wall of the cargo hold; and at least one discharge orifice, wherein the nozzle device is made of a material selected from the group consisting of aluminum, an aluminum alloy, carbon-fiber-reinforced plastic, and combinations thereof, and includes a layer of an intumescent material at least on a side facing the cargo hold in an installed state.

7. The nozzle device according to claim 6, wherein the nozzle device comprises a discharge nozzle.

8. The nozzle device according to claim 7, wherein the discharge nozzle is made of aluminum or an aluminum alloy.

9. The nozzle device according to claim 7, wherein the discharge nozzle holder has a material thickness in the range from 0.75 to 1.5 mm.

10. The nozzle device according to claim 6, wherein the layer of intumescent material has a layer thickness of more than 100 μm.

11. The nozzle device according to claim 6, wherein the layer of intumescent material has a layer thickness of more than 150 μm.

12. The nozzle device according to claim 7, wherein the layer is applied directly on a surface of the discharge nozzle facing the cargo hold and a surface of the discharge nozzle holder facing the cargo hold.

13. The nozzle device according to claim 6, wherein an anticorrosion layer is applied between the layer and the surface of the aluminum or the aluminum alloy.

14. A nozzle device for discharging a fire extinguishing medium into a cargo hold of an aircraft made of a material selected from the group consisting of aluminum, an aluminum alloy, a carbon-fiber-reinforced plastic, and combinations thereof, and a layer of an intumescent material at least on a side facing the cargo hold in an installed state, at least one portion of the nozzle device being made entirely of a carbon-fiber-reinforced plastic having a layer of an intumescent material on a side facing the cargo hold of the aircraft, wherein the nozzle device includes a discharge nozzle holder configured to be secured directly on a wall of the cargo hold.

15. The nozzle device according to claim 1, wherein the discharge nozzle holder is disc-shaped and the surface of the discharge nozzle holder facing the cargo hold is concave.

16. The nozzle device according to claim 1, wherein the discharge nozzle is configured to discharge a portion of the fire extinguishing medium against the surface of the discharge nozzle holder facing the cargo hold to purposefully discharge the fire extinguishing medium.

17. The nozzle device according to claim 6, further comprising a disc-shaped portion extending radially from the body portion having a concave surface facing the cargo hold of the aircraft.

18. The nozzle device according to claim 17, wherein the discharge orifice is configured to discharge a portion of the fire extinguishing medium against the concave surface of the disc-shaped portion facing the cargo hold to purposefully discharge the fire extinguishing medium.

* * * * *